US005542340A

United States Patent [19]

Murakami et al.

[11] Patent Number: 5,542,340

[45] Date of Patent: Aug. 6, 1996

[54] WAVE CAM TYPE COMPRESSOR

[75] Inventors: Kazuo Murakami; Toshiro Fujii; Kazuaki Iwama; Katsuya Ohyama, all of Kariya, Japan

[73] Assignee: Kabushiki Kaisha Toyoda Jidoshokki Seisakusho, Kariya, Japan

[21] Appl. No.: 539,128

[22] Filed: Oct. 4, 1995

[30] Foreign Application Priority Data

Oct. 5, 1994 [JP] Japan ..... 6-241586

[51] Int. Cl.[6] ..... F01B 3/00

[52] U.S. Cl. ..... 92/71; 92/138; 74/57; 74/56; 417/269

[58] Field of Search ..... 92/71, 138; 91/502; 74/56, 57; 417/269; 123/56.2

[56] References Cited

U.S. PATENT DOCUMENTS 2,176,300 10/1939 Fette .
3,570,463 3/1971 Nelson ..... 123/56.2
4,756,239 7/1988 Hattori et al. ..... 92/71
5,218,933 6/1993 Ehrlich ..... 123/56.2
5,452,647 9/1995 Murakami et al. ..... 92/71
5,477,773 12/1995 Murakami et al. ..... 417/269

*Primary Examiner*—Thomas E. Denion
*Attorney, Agent, or Firm*—Brooks Haidt Haffner & Delahunty

[57] ABSTRACT

A wave cam type compressor includes cylinder blocks. A drive shaft is rotatably supported in the center cylinder blocks. A plurality of cylinder bores are defined about the drive shaft in the cylinder blocks. A wave cam, mounted on the drive shaft, comprises opposing cam surfaces. A width of second portions which move a piston to its bottom dead center position is more narrow than a width of first portions which move a piston to its top dead center position. The pistons are connected to the wave cam by way of shoes. The shoes move along a predetermined path on the cam surfaces. The shoes and the wave cam convert the integral rotation of the drive shaft and wave cam to a reciprocating movement of the pistons to compress fluid introduced into the cylinder bores.

38 Claims, 7 Drawing Sheets

WAVE CAM TYPE COMPRESSOR

BACKGROUND OF THE INVENTION

1. Field of the Invention

The present invention relates generally to a compressor which compresses fluid, introduced into cylinder bores, by reciprocating pistons. More particularly, it pertains to a wave cam plate type compressor which reciprocates pistons by rotating a wave cam integrally attached to a drive shaft.

2. Description of the Related Art

In the prior art, swash plate type compressors are provided with a drive shaft, a swash plate, and pistons accommodated in associated cylinder bores. The swash plate is integrally fixed to the drive shaft and connected to each piston. In this type of compressor, fluid introduced into the cylinder bores is compressed by reciprocating movement of the pistons within the bores. The reciprocation is caused by integral rotation of the drive shaft and the wave cam. In this compressor, a movement diagram indicating axial displacement of a point following the swash plate surface during one rotation of the swash plate shows a single cycle sine wave curve. Hence, one compression stroke is performed per rotation of the drive shaft in the swash plate type compressor.

Wave cam type compressors have been developed to provide a compressor with a smaller size and an increased discharge volume as compared to swash plate type compressors. The wave cam type compressors are provided with a drive shaft, a wave cam, and pistons accommodated in associated cylinder bores. The wave cam is integrally fixed to the drive shaft and connected to each piston. In this type of compressor, fluid introduced into the cylinder bores is compressed by reciprocating movement of the pistons within the bores. The reciprocation is caused by integral rotation of the drive shaft and the wave cam. In the wave cam type compressor, a movement diagram indicating axial displacement of a point following the wave cam surface during one rotation of the wave cam shows a double cycle sine wave curve. Hence, two compression strokes are performed per rotation of the drive shaft in the wave cam type compressor. Thus, a wave type cam compressor has a larger discharge volume and a smaller size than a swash plate type compressor.

An example of such a wave cam type compressor is disclosed in Japanese Unexamined Patent Publication No. 57-110783. This compressor employs a wave cam having a front and a rear surface, and double-headed pistons having heads on its two ends. A roller, interposed between each cam surface and each piston, is rotatably and permanently fitted within the piston. Rotation of the wave cam moves the roller relatively with respect to the wave cam surfaces, axially displacing the contact point between the roller and the piston to reciprocate the pistons. The reciprocation of the pistons is based on a curve of the cam surface.

As shown in FIG. 9, a prior art wave cam 80 has a cam surface 81 including concave surfaces 81*a* and convex surfaces 81*b*. The surfaces 81*a*, 81*b* are formed continuously. When the center points of the concave surfaces 81*a* are aligned with a piston (not shown), the piston is located at a bottom dead center position. When the center points of the convex surfaces 81*b* are aligned with the piston, the piston is located at a top dead center position.

The cam surface 81 of the wave cam 80 shown in FIG. 9 reciprocates pistons via rollers (not shown). Therefore, the cam surface 81 of the wave cam 80 requires high precision grinding. To grind the cam surface 81, the wave cam 80 is rotated in one direction while a grinding stone 84, disposed parallel to the cam surface 81, is rotated by a shaft 83.

However, the shape of the cam surface 81 having continuous concave and convex surfaces 81*a*, 81*b* causes problems described below during its grinding.

FIGS. 10 and 11 show the cam surface 81 which is to be ground by a grinding stone 84. FIG. 10 shows a contact area $\alpha$ between the cam surface 81 and the grinding stone 84 during grinding of the convex surface 81*b*. FIG. 11 shows a contact area $\beta$ between the cam surface 81 and the grinding stone 84 during grinding of the concave surface 81*a*. As apparent from these drawings the contact area $\alpha$ is different from the contact area $\beta$. Therefore, grinding conditions differ between the concave and convex surfaces 81*a*, 81*b*. This lowers grinding accuracy, especially at the boundary portions between the concave and convex surfaces 81*a*, 81*b*, and may result in the cam surface 81 having inconsistent surface roughness and dimensions. As a result, rolling of the rollers between the wave cam 80 and the pistons may be rough and may cause a decrease in compressing efficiency of the compressor.

To cope with these problems, a wave cam 91 having a cam surface 92 that is entirely a convex surface 92*a*, as shown in FIG. 12, may be used. The contact area with a grinding stone is substantially equal at all points along the entire circumference of the cam surface 92.

However, the wave cam 91 may decrease grinding ability of the grinding stone due to ground dust clogging a grinding surface of the grinding stone. When the grinding surface becomes clogged, it is necessary to increase the pressing force of the grinding stone on the cam surface 92 to ensure the same predetermined grinding ability while continuously using the same grinding stone. The reaction force acting on the grinding stone becomes large when the pressing force is increased. Accordingly, when the grinding stone 84 shown in FIG. 9 is used to grind the cam surface 92, the pressing force deflects its shank 83. This leads to unsatisfactory contact between the grinding stone 84 and the cam surface 92 thus decreasing the grinding accuracy of the grinding stone 84 on the cam surface 92.

Furthermore, a plurality of wave cams 91 are successively ground by a single grinding stone in the manufacturing process. Hence, a grinding stone which may be used for a long period of time is desirable in the view point of manufacturing efficiency of the wave cam 91. Accordingly, a wave cam 91 having a cam surface 92 capable of prolonging the tool life of the grinding stone is desired.

SUMMARY OF THE INVENTION

Accordingly, it is a primary objective of the present invention to provide a wave cam type compressor which is capable of enhancing the tool life of a grinding tool utilized to grind the cam surfaces of the wave cam.

A further objective of the present invention is to provide a wave cam type compressor which is capable of suppressing grinding resistance changes of the grinding tool utilized to grind the cam surfaces of the wave cam.

To achieve the foregoing objectives, a wave cam type compressor is provided. The compressor has a wave cam supported on a drive shaft for an integral rotation and a piston disposed in a cylinder bore. The wave cam has a cam surface coupled to the piston by way of a shoe which is movable relative to the cam surface to reciprocally drive the piston between a top dead center and a bottom dead center of a piston stroke in the cylinder bore. Fluid is supplied to the cylinder bore based on a movement of the piston to the bottom dead center from the top dead center, and the fluid is compressed in the cylinder bore based on the movement of the piston to the top dead center from the bottom dead center. The cam surface has a first portion which includes a point corresponding to the top dead center of the piston stroke and a second portion which includes a point corresponding to the bottom dead center of the piston stroke. The second portion has a width narrower than a width of the first portion in a plan view along an axial direction with respect to the wave cam.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENT

An embodiment of a wave cam type compressor according to the present invention will now be described with reference to the drawings.

Figure 1:
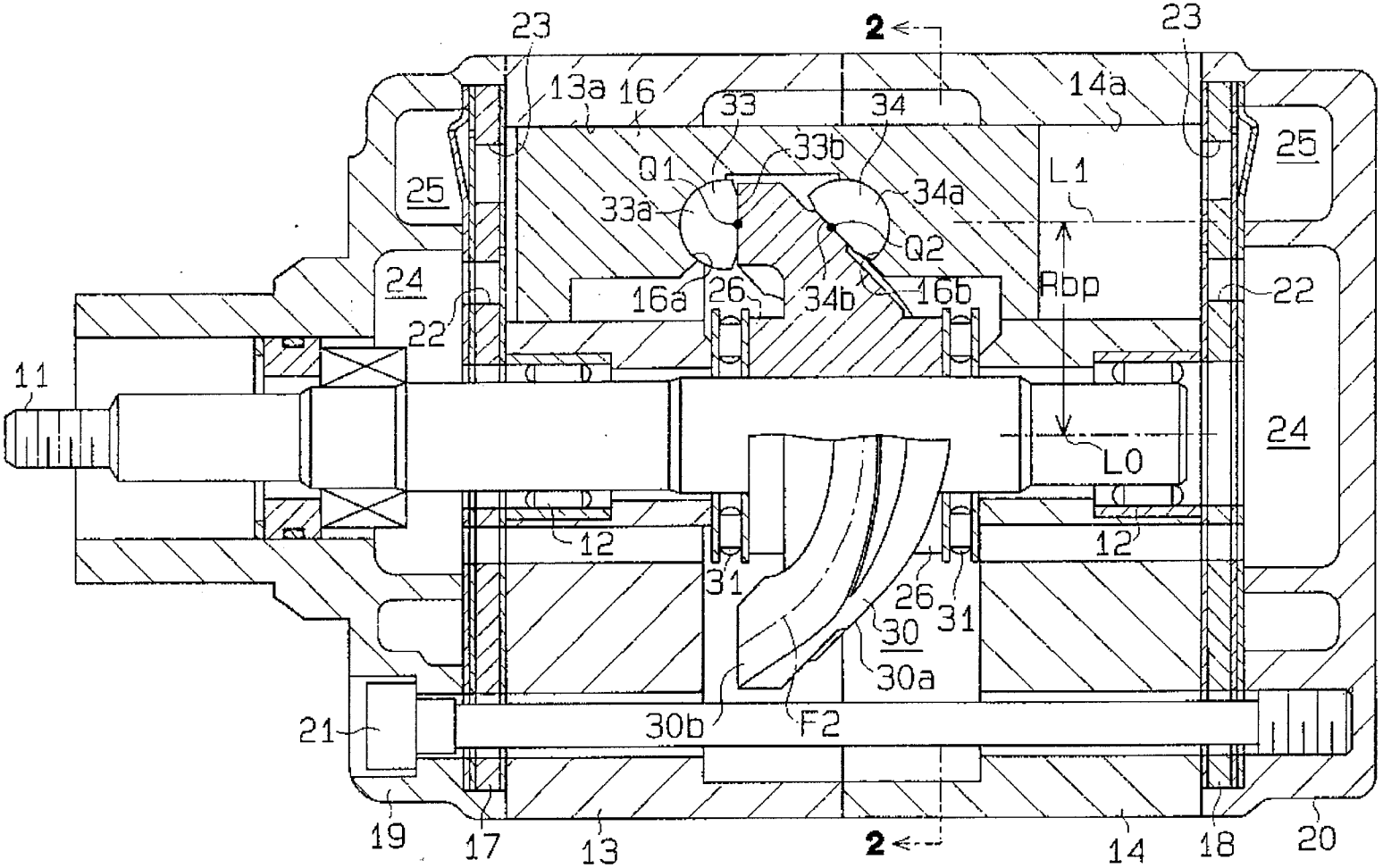
FIG. 1 is a cross-sectional view showing a wave cam type compressor according to an embodiment of the present invention.

As shown in FIG. 1, a drive shaft 11 is rotatably supported in a pair of cylinder blocks 13, 14 by bearings 12. Pairs of longitudinally aligned cylinder bores 13*a*, 14*a* are formed in the two cylinder blocks 13, 14 along the axial direction of the drive shaft 11. The cylinder bores 13*a*, 14*a* are arranged about the shaft 11 at equal angular intervals. A reciprocal double-headed piston 16 is accommodated in each pair of cylinder bores 13*a*, 14*a*. The piston 16 is provided with a piston head on each end. A front housing 19 and a rear housing 20 are securely fastened by bolts 21 to a front end of the cylinder block 13 and a rear end of the cylinder block 14 with valve plates 17, 18 provided between the blocks 13, 14 and the housings 19, 20, respectively. Suction chambers 24 and discharge chambers 25 are defined between the valve plates 17, 18 and the associated housings 19, 20. The chambers 24, 25 are respectively communicated with each cylinder bore 13*a*, 14*a* via suction ports 22 and discharge ports 23, which are formed in the valve plates 17, 18.

A wave cam 30 fixed to the drive shaft 11 rotates integrally with the shaft 11. The wave cam 30 has a front cam surface 30*b* and a rear cam surface 30*a*. Thrust bearings 31 are provided between the wave cam 30 and the cylinder blocks 13, 14 to absorb thrust acting on the drive shaft 11. Semi-spherical shoes 33, 34 are interposed between each cam surface 30*b*, 30*a* and each piston 16. Each shoe 33, 34 has a spherical surface 33*a*, 34*a* and a flat surface 33*b*, 34*b*. The spherical surface 33*a*, 34*a* are received in associated recess portion 16*a*, 16*b* which are formed in the piston 16. The flat surfaces 33*b*, 34*b* slide on the associated cam surfaces 30*b*, 30*a*.

Figure 2:
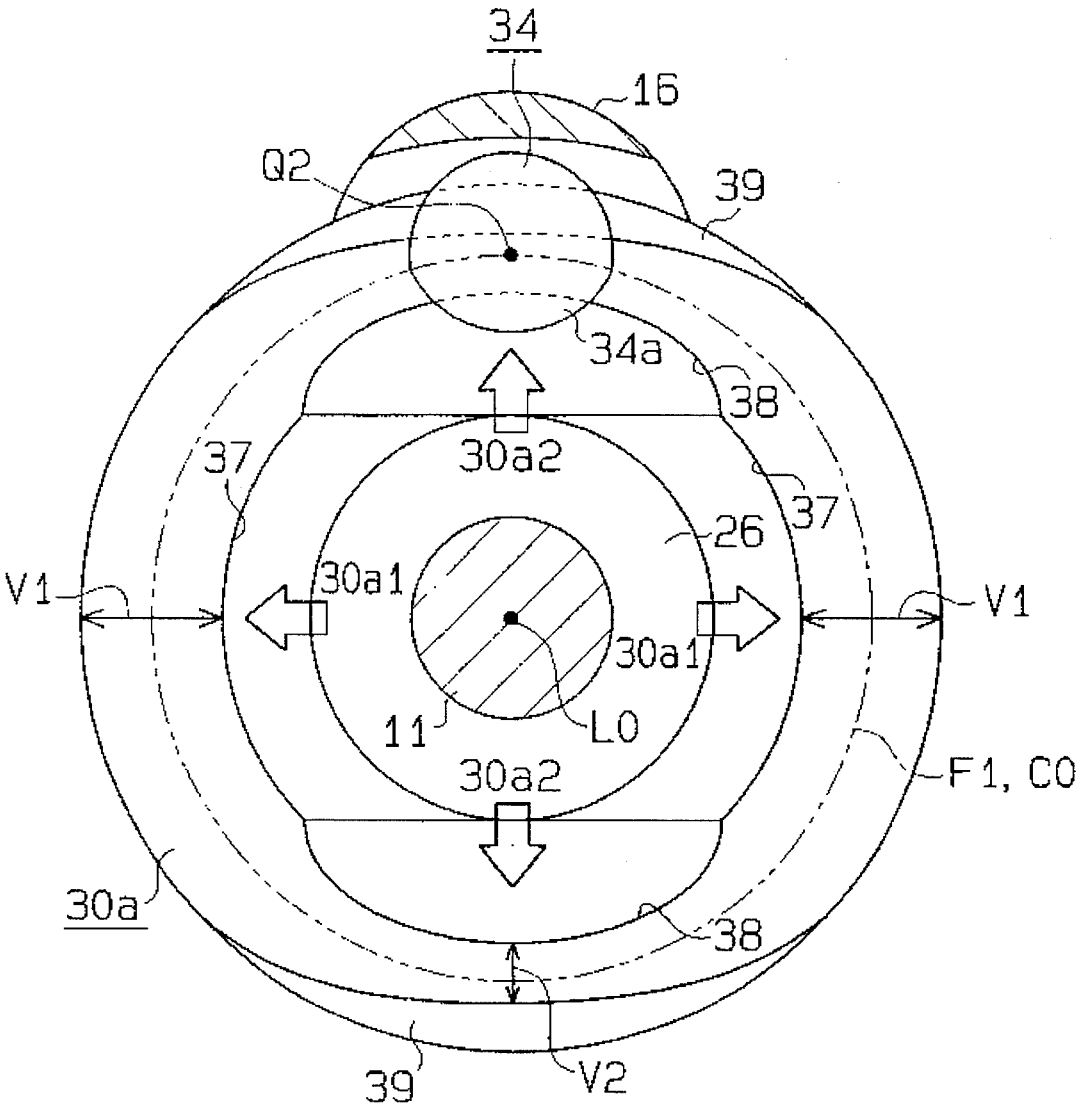
FIG. 2 is a cross-sectional view of FIG. 1 on line 2—2.
Figure 3:
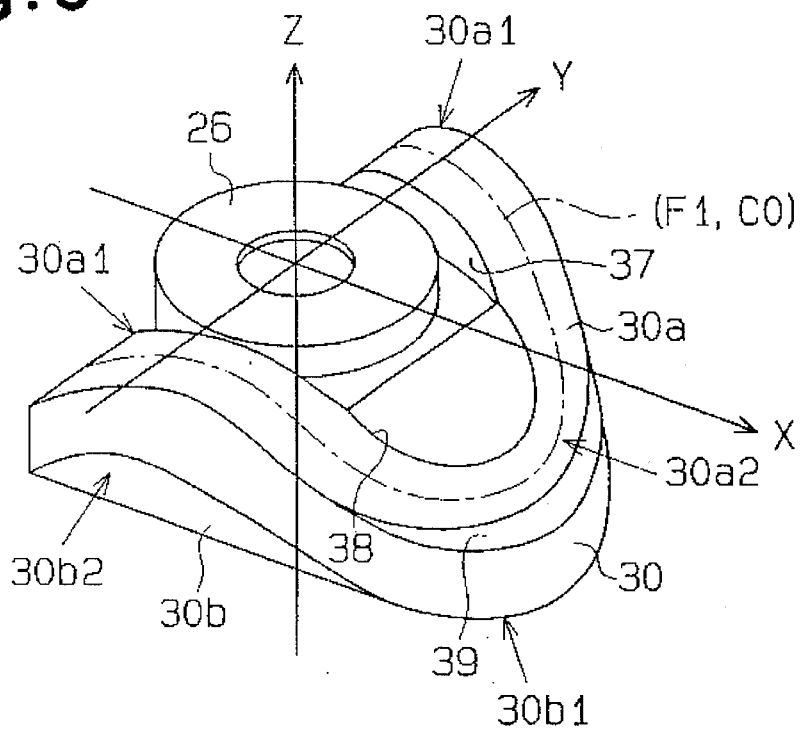
FIG. 3 is a perspective view showing a wave cam with a cylindroid surface.

As shown in FIGS. 2 and 3, an imaginary circumference C0 corresponds to the arrangement of axes L1 of the cylinder bores 13*a*, 14*a*. As shown in FIGS. 1 through 3, a set of movement curves F1, F2 on the cam surfaces 30*a*, 30*b*, respectively, are defined by the intersection of an imaginary cylinder having an axis coinciding with L0 and a circumference equal to C0. The center of the circumference C0 and the center axis of the wave cam 30 both coincide with the axis L0 of the drive shaft 11. The radius of the circumference C0 is Rbp as shown in FIG. 1. Each shoe 33, 34 following the associated movement curve F1, F2 is periodically and alternately displaced forward and backward twice in the axial direction of the drive shaft 11 during one rotation of the wave cam 30. Centers Q1, Q2 of the spherical surfaces 33*a*, 34*a* coincide with the centers of the flat surfaces 33*b*, 34*b*, respectively. This allows the centers Q1, Q2 to constantly slide along the associated curves F1, F2. Accordingly, reciprocal movement of the pistons 16 within the associated cylinder bores 13*a*, 14*a* corresponds to the displacement of the pistons 16 along movement curves F1, F2 during rotation of the wave cam 30.

Figure 4:
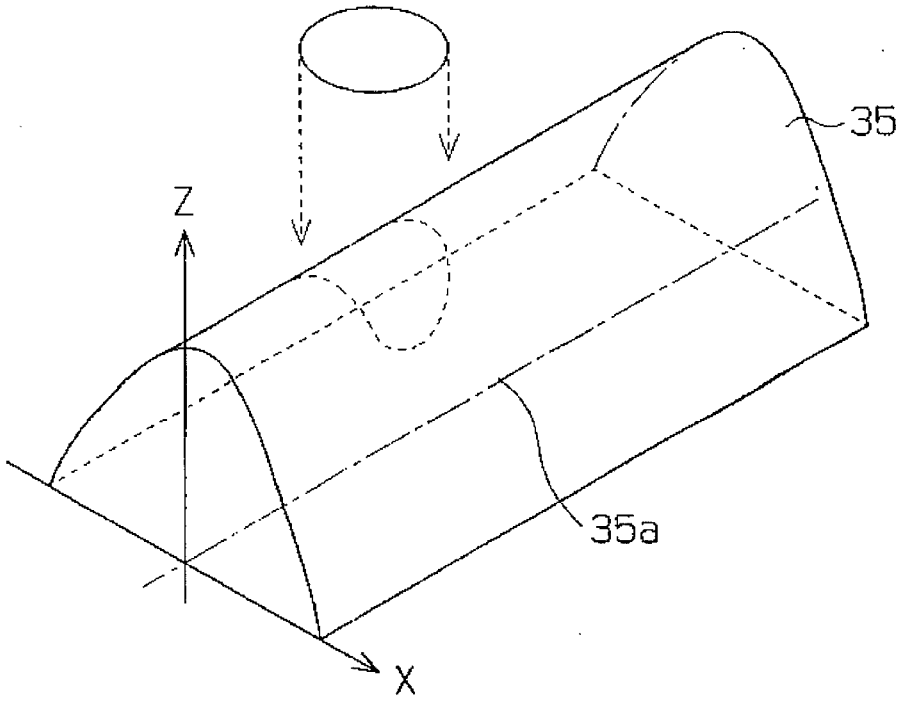
FIG. 4 is a perspective view of a conceptual parabolic surface.

As shown in FIG. 3, both cam surfaces 30*a*, 30*b* of the wave cam 30 are formed along a surface of a predetermined imaginary cylindroid (hereinafter referred to as cylindroid surface). The cam surfaces 30*a*, 30*b* each have a pair of first portions 30*a*1, 30*b*1 and a pair of second portions 30*a*2, 30*b*2. The first portions 30*a*1, 30*b*1 each move the one head of a piston 16 to its top dead center position when aligned therewith while moving the opposing head to its bottom dead center position in the associated cylinder bore 13*a*, 14*a*. The second portions 30*a*2, 30*b*2 each move the one head of a piston 16 to its bottom dead center position when aligned therewith while moving the opposing head to its top dead center position in the associated cylinder bore 13*a*, 14*a*. Cross-sectional views of the wave cam 30 along line segments perpendicular to a line connecting the two first portions 30*a*1 of the cam surface 30*a* each show identical contours. The above cylindroid surface is defined by moving a straight line along the contour, or director curve as indicated in FIG. 4.

Provided that a Z axis coincides with the axis L0, and that an X axis is orthogonal to a Y axis coincided with a line connecting the two first portions 30*a*1, which move the corresponding head of the pistons to the top dead center position, the above-described cylindroid surface is represented by the following equation (1):

$$Z=f(x) \quad (1)$$

The curved surface of each cam surface 30*a*, 30*b* is defined by a parabola, obtained from the next equation (2) in which X and Z are used as parameters, as the director curve. An imaginary parabolic semicylindroid is generated from the director curve. As shown in FIG. 4, the parabolic semicylindroid surface (hereinafter referred to as parabolic surface) 35 is cut from above along a circle to obtain the curved surfaces of each cam surface 30*a*, 30*b*. Two of such parabolic surfaces 35 are combined back to back on the front and rear sides of the wave cam 30 to form the cam surfaces 30*a*, 30*b*. The parabolic surface 35 of the semicylindroid is generated by the director curve represented in the following equation (2):

$$Z=-C1\cdot X^2+C2 \quad (2)$$

C1 and C2 are constants which are determined by the dimensions of the compressor.

Employment of the parabolic surface 35 allows the two second portions 30*a*2 on the cam surface 30*a* to be separated from each other by an angular interval of 180°. In the same manner, the two second portions 30*b*2 and the two first portions 30*a*1 and 30*b*1 on the cam surfaces 30*a* and 30*b*, respectively, are separated from each other by angular intervals of 180°. Furthermore, the first portions 30*a*1, 30*b*1 are respectively separated from the second portions 30*a*2, 30*b*2 by angular intervals of 90°. Each second portion 30*a*2 of the surface 30*a* is formed back to back with each first portion 30*b*1 on the opposite surface 30*b*. Each first portion 30*a*1 of the surface 30*a* is formed back to back with each second portion 30*b*2 on the opposite surface 30*b*. Accordingly, the cam surfaces 30*a* and 30*b* are arranged in a manner such that there is a phase difference of 90° therebetween. In addition, the cam surfaces 30*a*, 30*b*, employing the parabolic surface 35, are convex.

For smooth reciprocation of the piston 16, the distance between each associated pair of shoes 33, 34 at the respective centers Q1, Q2 of the spherical surfaces 33*a*, 34*a* is required to be constant. That is, the distance between the movement curves F1, F2 must be constant along the direction of the axis L0. In order to satisfy this requirement, two conditions must be fulfilled.

The first condition is that the cam surfaces 30*a*, 30*b* of the wave cam 30 have the same contour. The second condition is that the first portions 30*a*1, 30*b*1 of the respective cam surfaces 30*a*, 30*b*, which move the corresponding head of each piston 16 to the top dead center position, and the second portions 30*a*2, 30*b*2 of the respective cam surfaces 30*a*, 30*b*, which move the corresponding head of each piston 16 to the bottom dead center position, have symmetrical contours.

The first condition is satisfied by employing the parabolic surface 35 cut along a circle as described above for each cam surface 30*a*, 30*b*. The second condition is satisfied by the cam surfaces 30*a*, 30*b* having a contour of a sine wave curve. In this embodiment, provided that the rotation angle of the wave cam 30 is indicated by θ and the stroke of the piston 16 is indicated by H, the relationship between the displacement of the centers Q1, Q2 of the respective shoes 33, 34 in the direction of Z axis and the rotation angle θ is indicated by the following equation (3):

$$Z(\theta)=(H/2)\cdot\cos(2\theta) \quad (3)$$

Since the cam surfaces 30*a*, 30*b* of the wave cam 30 have identical contours in this embodiment, a description of only the surface 30*a* will be given below. The rotation angle θ of the wave cam 30 is defined as 0° when the piston 16 is at the top dead center position in the cylinder bores 13*a*, 14*a*. The Z axis coincides with the axis L0 of the drive shaft 11. The Y axis is parallel to an axis 35*a* of the parabolic surface 35 which constitutes the cam surface 30*a*. The X axis is parallel to the axis 35*a* of the parabolic surface 35 which constitutes the cam surface 30*b*.

Figure 5:
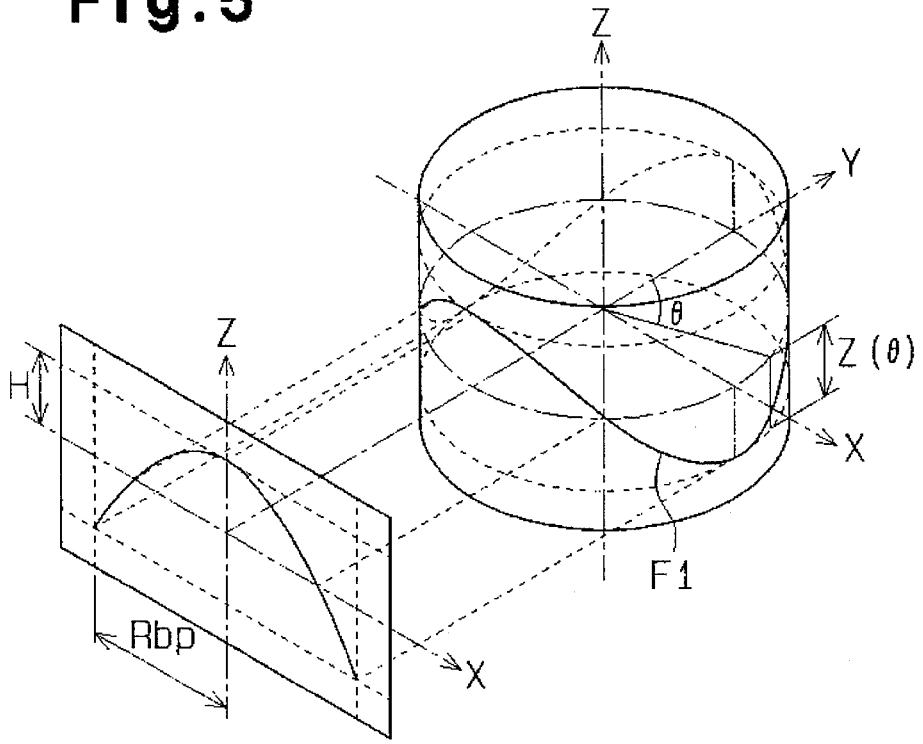
FIG. 5 is a diagram conceptually showing a movement curve of a wave cam surface.

As shown in FIG. 5, when the equation (3) is projected onto an X-Z plane, the X coordinate of Z(θ) is represented by the following equation (4):

$$X(\theta)=Rbp\cdot\sin\theta \quad (4)$$

Rbp indicates the radius of the circumference CO. From the equations (3) and (4), the relationship between the Z coordinate and the X coordinate is represented by the following equation (5):

$$Z(\theta)=(H/2)\cdot\cos(2\theta)=(H/2)\cdot(1-2\cdot\sin^2\theta)$$

$$\therefore Z(X)=(H/2)\cdot(1-2X^2/Rbp^2)=H/2-H\cdot X^2/Rbp^2 \quad (5)$$

The equation (5) represents a parabola and the following equation (6) is derived from the equations (2) and (5).

$$C1=H/Rbp^2$$

$$C2=H/2 \quad (6)$$

Namely, employment of the parabolic surface 35, which is generated from the director curve satisfying the equation (6), for the cam surfaces 30*a*, 30*b* of the wave cam 30 reciprocates the pistons 16 smoothly.

FIG. 2 is a cross-sectional view of FIG. 1 along line 2—2 showing one of the cam surfaces 30*a* of the wave cam 30. Since the cam surfaces 30*a*, 30*b* of the wave cam 30 have identical shapes, description of only the surface 30*a* will be given below. The wave cam 30 has a boss 26, grooves 37, and recesses 38. The boss 26 is fit onto the drive shaft 11. The grooves 37 and recesses 38 are defined between the boss 26 and the cam surface 30*a*. Each groove 37, which neighbors each associated first portion 30*a*1, extends along the same circumference. The center of the circumference coincides with the center of the boss 26. Each recess 38, which neighbors each associated second portion 30*a*2, extends more outward on the wave cam 30 than the grooves 37. The wave cam 30 has inclined surfaces 39, which are formed on the outer side of the cam surface 30*a* opposing the recess 38. Accordingly, a width V2 of the cam surface 30*a* in the vicinity of the second portion 30*a*2, which is interposed between the recess 38 and the inclined surface 39, is more narrow than when compared with a width V1 of the cam surface 30*a* in the vicinity of the first portion 30*a*1. A plan view of the wave cam 30 in the direction of the axis L0 indicates the width V1 being more narrow than the width V2 on each cam surface 30*a*, 30*b*. The width V1 is more narrow than the flat surfaces 33*b*, 34*b* of the respective shoes 33, 34.

The operation of the wave cam type compressor having the above structure will now be described. When the drive shaft 11 and the wave cam 30 are integrally rotated, the motion of the wave cam 30 reciprocates each piston 16 inside its associated cylinder bore 13*a*, 14*a* via the shoes 33, 34. As one of the heads of the piston 16 is moved from its top dead center position to its bottom dead center position in the associated cylinder bore 13*a*, 14*a*, refrigerant gas is introduced into the bores 13*a*, 14*a* from the suction chambers 24 through the suction ports 22. One of the heads of the piston 16 is then moved from its bottom dead center position to its top dead center position. This compresses the gas in the cylinder bores 13*a*, 14*a* and discharges the compressed gas into the discharge chambers 25 through the discharge ports 23.

During the reciprocation of the piston 16, the flat surfaces 33*b*, 34*b* of the shoes 33, 34 relatively rotate about the drive shaft 11 on the associated cam surfaces 30*a*, 30*b* of the wave cam 30 along the respective movement curves F1, F2. The movement curve F2 on the cam surface 30*b* is offset $\pi/2$ from the phase of the movement curve F1 on the cam surface 30*a*. The interval between the two curves F1, F2 in the direction of the Z axis, or the shaft 11 is constantly equal.

The manufacturing method of the wave cam 30 will now be described. The original form of the wave cam 30 is obtained through molding such as die casting. The surface of the molded product is then deburred and holes are machined at predetermined positions. Finally, the surface of the molded product is ground to obtain the wave cam 30 with the cam surfaces 30*a*, 30*b*.

Figure 6:
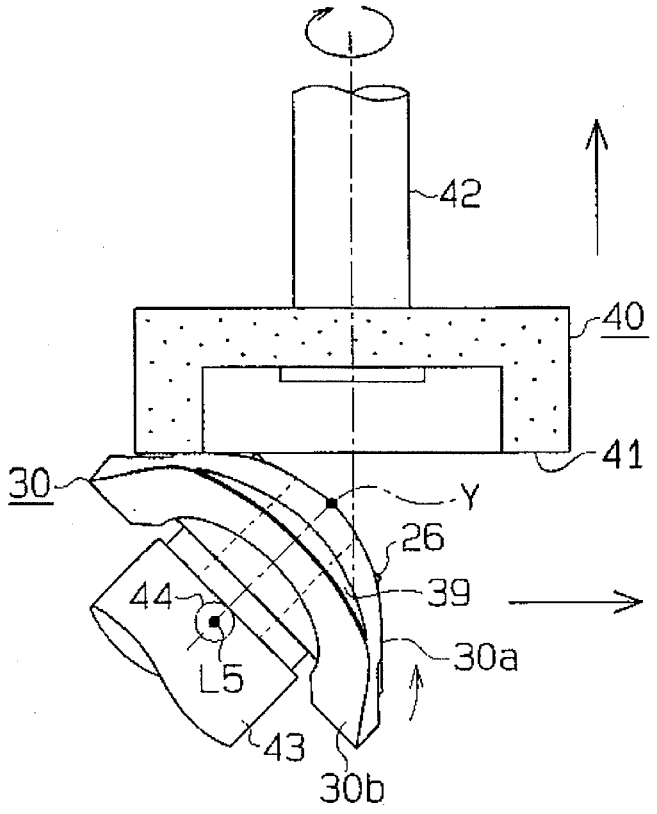
FIG. 6 is a side view showing a grinding stone and a tiltable rotary table during grinding of the wave cam.

As shown in FIG. 6, an NC milling machine including a grinding stone 40 and a tiltable rotary table 43 are used for grinding the wave cam 30 in the present embodiment. The grinding stone 40, having a straight-cup configuration, has a grinding face 41 on its end portion. The outer diameter of the grinding stone 40 is larger than the wave cam 30. A shank 42 of the grinding stone 40 is mounted to a spindle (not shown) of the NC milling machine. The tiltable rotary table 43 is mounted on a table (not shown) of the NC milling machine. A portion of the rotary table 43 is fit into a hole of the boss 26 on the wave cam 30. The wave cam 30 is unrotatable in relation to the rotary table 43. The rotary table 43 is tiltable in the clockwise and counterclockwise directions of FIG. 6 about its pivoting shaft 44. The wave cam 30 is supported in a manner that a center axis L5 of the pivot shaft 44 and the Y axis, which runs along each first portion 30*a*1 of the cam surface 30*a* are parallel to each other.

Figure 7:
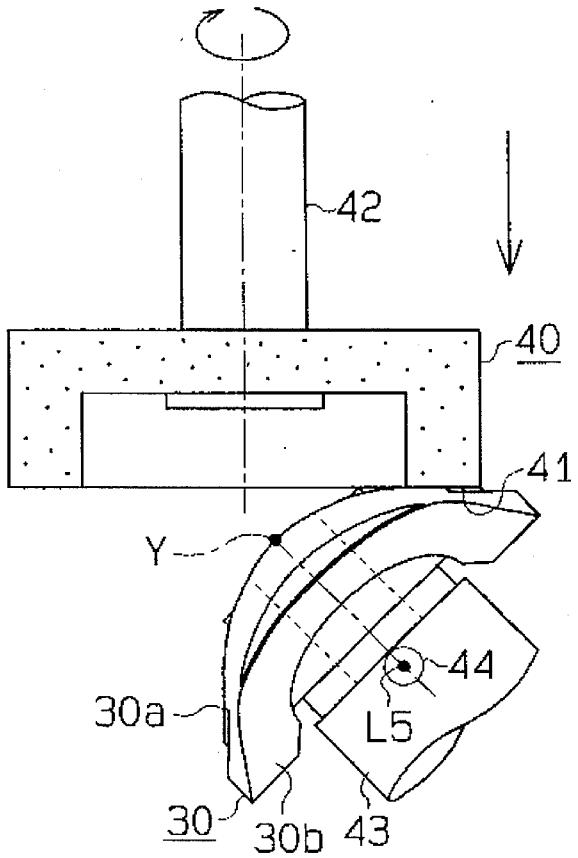
FIG. 7 is a side view showing the rotary table in a state tilted from the state of FIG. 6.

To grind the cam surface 30*a*, the grinding stone 40 first commences rotation and is then lowered until its grinding face 41 comes into contact with the cam surface 30*a*. The tilting angle of the rotary table 43 is adjusted to allow contact with the grinding face 41 in the vicinity of one of the second portions 30*a*2 of the cam surface 30*a*. As shown in FIG. 6, the grinding stone 40 is lowered until a predetermined depth of the cam surface 30*a* is ground. From this state, the rotary table 43 is simultaneously pivoted in the counterclockwise direction and moved horizontally while the grinding stone 40 is gradually raised to maintain the depth of grinding at a constant amount. When the contacting portion between the cam surface 30*a* and the grinding stone 40 reaches the first portion 30*a*1, the grinding stone 40 is gradually lowered once more. Furthermore, when the contact portion between the cam surface 30*a* and the grinding stone 40 reaches the other second portion 30*a*2 as shown in FIG. 7, the grinding stone 40 is raised and separated from the cam surface 30*a* thus completing the grinding. The cam surface 30*b* is ground in the same manner.

The sequential movements, such as the lowering and raising of the grinding stone 40 and the pivoting of the rotary table are controlled by a computer mounted on the NC milling machine which executes a machining program.

In this embodiment, the wave cam 30 is provided with the grooves 37 and the recesses 38. Each groove 37 is defined at the inner side of the cam surfaces 30*a*, 30*b* and neighbors the respective first portions 30*a*1, 30*b*1, each of which moves the corresponding head of the piston 16 to the top dead center position. The recess 38 is extended outwardly. In addition, the wave cam 30 includes the inclined surface 39 which is formed on the outer side of the cam surfaces 30*a*, 30*b*. Namely, the width V2 of the cam surfaces 30*a*, 30*b* at the respective second portions 30*a*2, 30*b*2 is more narrow than when compared with the width V1 of the cam surfaces 30*a*, 30*b* at the first portions 30*a*1, 30*b*1.

Accordingly, the hollowed portion of the wave cam 30, where the width V2 is narrow, allows a reduction in weight of the wave cam 30. Additionally, the width V2 of the cam surfaces 30*a*, 30*b* at the respective second portions 30*a*2, 30*b*2, which move the corresponding head of each piston 16 to the bottom dead center position, is more narrow than when compared with the width V1 of the cam surfaces 30*a*, 30*b* at the respective first portions 30*a*1, 30*b*1. Therefore, the contact area between the cam surfaces 30*a*, 30*b* and the grinding stone 40 is reduced. This allows minimizing of the area to be ground by the grinding stone 40 and contributes to prolonging its tool life.

In this embodiment, although the width V2 of the cam surfaces 30*a*, 30*b* at the vicinity of the second portions 30*a*2, 30*b*2 is narrow, the pressing force which acts on these portions 30*a*2, 30*b*2 is small. Refrigerant gas introduced into the cylinder bores 13*a*, 14*a* is compressed when each head of the piston 16 is moved from the bottom dead center position to the top dead center position. When the piston 16 is moved to the vicinity of the top dead center position, the compression reaction force applied to the cam surfaces 30*a*, 30*b* via the associated shoes 33, 34 is maximized since the pressure inside the cylinder bores 13*a*, 14*a* is maximized. Therefore, it is desirable for the width V1 of the cam surfaces 30*a*, 30*b* at the respective first portions 30*a*1, 30*b*1 to be substantially equal to the width of the flat surfaces 33*b*, 34*b* of the respective shoes 33, 34.

Contrarily, when refrigerant gas is being introduced into the cylinder bores 13*a*, 14*a*, the pressure inside the cylinder bores 13*a*, 14*a* becomes negative. As a result, the reaction force applied to the cam surfaces 30*a*, 30*b* via the respective shoes 33, 34 is so small that it may be disregarded.

In this embodiment, the grinding face 41, which is on the end portion of the grinding stone 40, is pressed against the cam surfaces 30*a*, 30*b* perpendicular thereto during grinding. Therefore, the moment acting on the shank 42 is minimized and deflection of the shank 42 is prevented. This enables high precision grinding of the cam surfaces 30*a*, 30*b*. As a result, production of the wave cam 30 with high dimensional accuracy is possible. By using such wave cam 30, it is possible to manufacture a wave cam type compressor having a high compressing efficiency.

Figure 8:
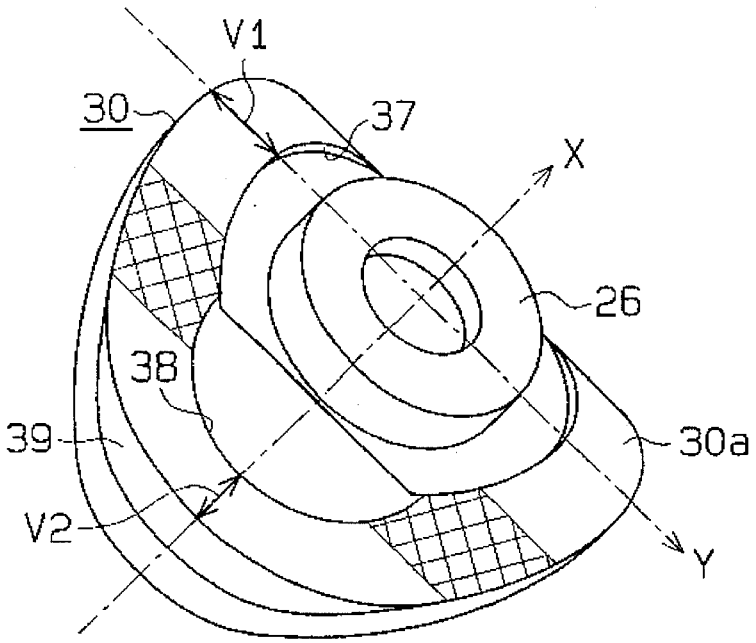
FIG. 8 is a perspective view showing the wave cam in a ground state.
Figure 9:
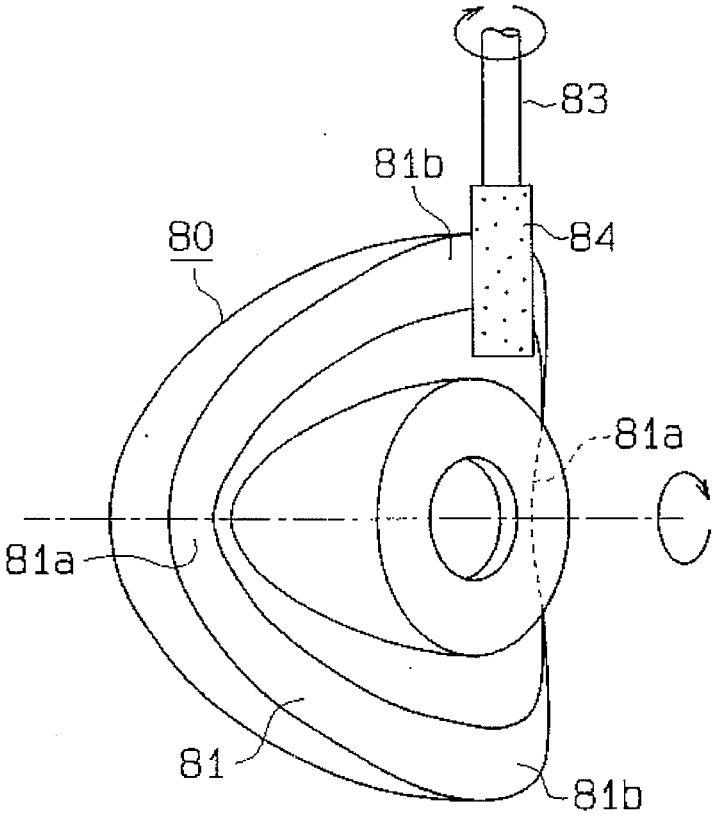
Fig.9 (Prior Art)
FIG. 9 is a perspective view of a prior art wave cam, having a cam surface with concave and convex surfaces, undergoing grinding.
Figure 10:
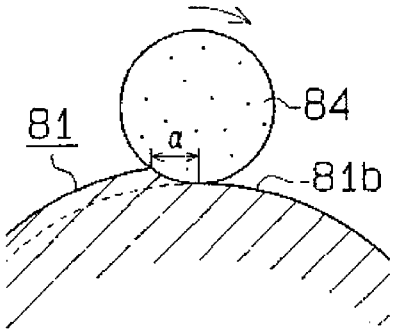
Fig.10 (Prior Art)
FIG. 10 is a partial cross-sectional view of the convex surface of the wave cam shown in FIG. 9 undergoing grinding.
Figure 11:
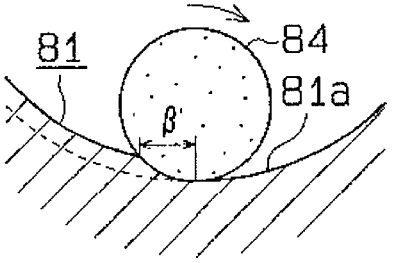
Fig.11 (Prior Art)
FIG. 11 is a partial cross-sectional view of the concave surface of the wave cam shown in FIG. 9 undergoing grinding.
Figure 12:
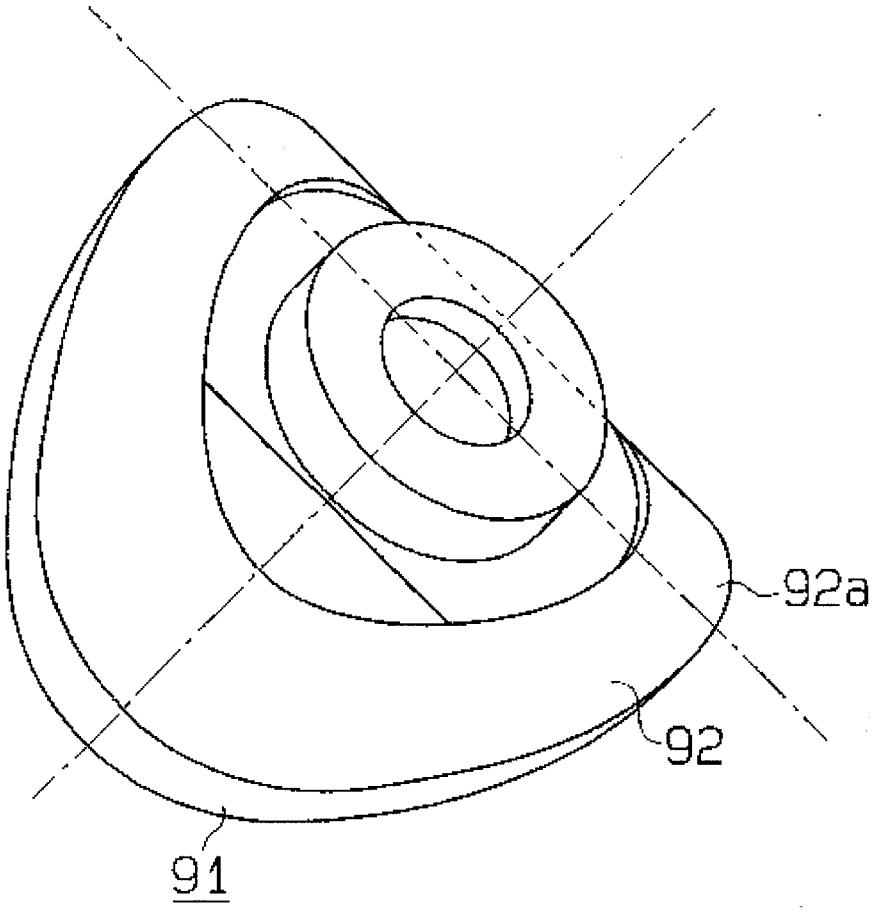
Fig.12 (Prior Art)
FIG. 12 is a perspective view of a prior art wave cam having a cam surface which comprises only convex surfaces.

Furthermore, in this embodiment, the grinding stone 40 used to grind the wave cam 30 has an outer diameter larger than the outer diameter of the cam wave 30. Therefore, it is possible to simultaneously grind two portions that are symmetrical about the X axis as shown in the cross-hatched area of FIG. 8. This allows the wave cam 30 to be formed having the same surface roughness and the same dimension at portions which are symmetrical to each other about the X axis. In addition, it is possible to greatly reduce the grinding time of the wave cam 30.

Although only one embodiment of the present invention has been described herein, it should be apparent to those skilled in the art that the present invention may be embodied in many other specific forms without departing from the spirit or scope of the invention. Particularly, it should be understood that the present invention may be embodied in the forms described below.

In the above embodiment, the cam surfaces 30*a*, 30*b* are formed from portions of the imaginary parabolic surface 35. Contrarily, a wave cam including both concave and convex surfaces may be employed. In this mode, it is significant for the width of the cam surfaces at the second portions, which move the piston to the bottom dead center position, to be narrow.

The grinding stone 40 has an outer diameter which is larger than the outer diameter of the wave cam 30 in the above embodiment. However, significance is placed on the width of the grinding stone being wider than the cam surface, and the axis of the grinding stone being positioned perpendicular to the cam surface during grinding. This prevents deflection of the grinding stone shank and achieves high precision grinding of the cam surface, which is an object of the present invention.

The director curve uses a predetermined parabola to obtain the imaginary parabolic surface 35 which forms the cam surfaces 30*a*, 30*b* in the above embodiment. However, the director curve may use any kind of curve which is symmetrical about the z axis as in the above embodiment.

Therefore, the present example and embodiments are to be considered as illustrative and not restrictive and the invention is not to be limited to the details given herein, but may be modified within the scope of the appended claims.

What is claimed is:

1. A compressor having a wave cam supported on a drive shaft for an integral rotation and a piston disposed in a cylinder bore, said wave cam having a cam surface coupled to the piston by way of a shoe which is movable relative to said cam surface to reciprocally drive said piston between a top dead center and a bottom dead center of a piston stroke in the cylinder bore, wherein fluid is supplied to the cylinder bore based on a movement of the piston to the bottom dead center from the top dead center, and wherein said fluid is compressed in the cylinder bore based on the movement of the piston to the top dead center from the bottom dead center, said compressor comprising:

said cam surface having a first portion which includes a point corresponding to the top dead center of the piston stroke and a second portion which includes a point corresponding to the bottom dead center of the piston stroke; and said second portion having a width narrower than a width of the first portion in a plan view along an axial direction with respect to the wave cam.

2. The compressor as set forth in claim 1, wherein said cam surface includes a part of surface of a preselected imaginary cylindroid.

3. The compressor as set forth in claim 2, wherein said shoe includes a flat surface contacting said cam surface and a spherical surface coupled to the piston.

4. The compressor as set forth in claim 3, wherein said second portion has the width narrower than a width of said flat surface of the shoe.

5. The compressor as set forth in claim 1, wherein said cam surface includes:

another first portion to form a pair of first portions with said first portion;

another second portion to form a pair of second portions with said second portion;

said pair of first portions being separated from one another by 180°;

said pair of second portions being separated from one another by 180°; and each of said pair of first portions being separated from the adjacent second portion by 90°.

6. The compressor as set forth in claim 2, further comprising:

a boss provided with the wave cam to firmly receive the drive shaft;

said wave cam including a groove and a recess;

said cam surface circularly extending about the boss;

said groove being arranged adjacent to the first portion;

said recess being arranged adjacent to the second portion; and said recess outwardly expanding with respect to the groove to narrow the second portion as compared to the first portion.

7. The compressor as set forth in claim 2, further comprising:

a boss provided with the wave cam to firmly receive the drive shaft;

said wave cam including a groove and a recess;

said cam surface circularly extending about the boss; and said second portion being inwardly cut away for a predetermined amount to narrow the second portion with respect to the first portion.

8. The compressor as set forth in claim 2, wherein said imaginary cylindroid includes a convex surface obtainable from a director curve including a preselected parabolic curve.

9. The compressor as set forth in claim 2, wherein said imaginary cylindroid includes a parabolic surface obtainable from a preselected parabolic curve as a director curve.

10. The compressor as set forth in claim 2, wherein said cam surface includes:

another first portion to form a pair of first portions with said first portion;

another second portion to form a pair of second portions with said second portion;

said pair of first portions being separated from one another by 180°;

said pair of second portions being separated from one another by 180°; and each of said pair of first portions being separated from the adjacent second portion by 90° surface.

11. A compressor having a wave cam supported on a drive shaft for an integral rotation and a piston disposed in a cylinder bore, said wave cam having a cam surface coupled to the piston by way of a shoe which is movable relative to said cam surface to reciprocally drive said piston between a top dead center and a bottom dead center of a piston stroke in the cylinder bore, wherein fluid is supplied to the cylinder bore based on a movement of the piston to the bottom dead center from the top dead center, and wherein said fluid is compressed in the cylinder bore based on the movement of the piston to the top dead center from the bottom dead center, said compressor comprising:

said cam surface including a part of surface of a preselected imaginary cylindroid;

said cam surface having a first portion which includes a point corresponding to the top dead center of the piston stroke and a second portion which includes a point corresponding to the bottom dead center of the piston stroke;

said second portion having a width narrower than a width of the first portion in a plan view along an axial direction with respect to the wave cam;

said shoe including a flat surface contacting said cam surface and a spherical surface coupled to the piston; and said second portion including the width narrower than a width of said flat surface of the shoe.

12. The compressor as set forth in claim 11 further comprising:

a boss provided with the wave cam to firmly receive the drive shaft;

said wave cam including a groove and a recess;

said cam surface circularly extending about the boss;

said groove being arranged adjacent to the first portion;

said recess being arranged adjacent to the second portion; and said recess outwardly expanding with respect to the groove to narrow the second portion as compared to the first portion.

13. The compressor as set forth in claim 11 further comprising:

a boss provided with the wave cam to firmly receive the drive shaft;

said wave cam including a groove and a recess;

said cam surface circularly extending about the boss; and said second portion being inwardly cut away for a predetermined amount to narrow the second portion with respect to the first portion.

14. The compressor as set forth in claim 11, wherein said imaginary cylindroid includes a parabolic surface obtainable from a preselected parabolic curve as a director curve.

15. A compressor having a wave cam supported on a drive shaft for an integral rotation and a piston disposed in a cylinder bore, said wave cam having a cam surface coupled to the piston by way of a shoe which is movable relative to said cam surface to reciprocally drive said piston between a top dead center and a bottom dead center of a piston stroke in the cylinder bore, wherein fluid is supplied to the cylinder bore based on a movement of the piston to the bottom dead center from the top dead center, and wherein said fluid is compressed in the cylinder bore based on the movement of the piston to the top dead center from the bottom dead center, said compressor comprising:

said cam surface including a part of surface of a preselected imaginary cylindroid;

said cam surface having a first portion which includes a point corresponding to the top dead center of the piston stroke and a second portion which includes a point corresponding to the bottom dead center of the piston stroke;

another first portion to form a pair of first portions with said first portion;

another second portion to form a pair of second portions with said second portion;

said pair of first portions being separated from one another by 180°;

said pair of second portions being separated from one another by 180°;

each of said pair of first portions being separated from the adjacent second portion by 90°;

said second portion having a width narrower than a width of the first portion in a plan view along an axial direction with respect to the wave cam;

said shoe including a flat surface contacting said cam surface and a spherical surface coupled to the piston; and said second portion having the width narrower than a width of said flat surface of the shoe.

16. The compressor as set forth in claim 15 further comprising:

a boss provided with the wave cam to firmly receive the drive shaft;

said wave cam including a groove and a recess;

said cam surface circularly extending about the boss;

said groove being arranged adjacent to the first portion;

said recess being arranged adjacent to the second portion;

said recess outwardly expanding with respect to the groove to widen the first portion as compared to the second portion; and said imaginary cylindroid including a parabolic surface obtainable from a preselected parabolic curve as a director curve.

17. The compressor as set forth in claim 15 further comprising:

a boss provided with the wave cam to firmly receive the drive shaft;

said wave cam including a groove and a recess;

said cam surface circularly extending about the boss;

said second portion being inwardly cut away for a predetermined amount to narrow the second portion with respect to the first portion; and said imaginary cylindroid includes a parabolic surface obtainable from a preselected parabolic curve as a director curve.

18. The compressor as set forth in claim 15 further comprising:

a boss provided with the wave cam to firmly receive the drive shaft;

said wave cam including a groove and a recess;

said cam surface circularly extending about the boss;

said groove being arranged adjacent to the first portion;

said recess being arranged adjacent to the second portion;

said recess outwardly expanding with respect to the groove to narrow the second portion as compared to the first portion; and said second portion being inwardly cut away for a predetermined amount to narrow the second portion with respect to the first portion.

19. The compressor as set forth in claim 18, wherein said imaginary cylindroid includes a parabolic surface obtainable from a preselected parabolic curve as a director curve.

20. A compressor having a wave cam supported on a drive shaft for an integral rotation and a plurality of pairs of cylinder bores arranged around an axis of said drive shaft, each pair of said cylinder bores being arranged opposite to one another with respect to the wave cam along said axis, a plurality of double-headed pistons respectively disposed in said cylinder bores, said wave cam having a pair of opposing cam surfaces having an identical cam profile and coupled to each of said double-headed pistons by way of a pair of shoes respectively contacting the cam surfaces for a relative movement to the cam surfaces to reciprocally drive a pair of piston heads of the associated double-headed piston between a top dead center and a bottom dead center of a piston stroke in the associated pair of the cylinder bores, wherein fluid is supplied to each cylinder bore based on a movement of each piston head to the bottom dead center from the top dead center, and wherein said fluid is compressed in each cylinder bore based on the movement of each piston head to the top dead center from the bottom dead center, said compressor comprising:

each of said cam surfaces having a first portion which includes a point corresponding to the top dead center of the piston stroke and a second portion which includes a point corresponding to the bottom dead center of the piston stroke; and said second portion having a width narrower than a width of the first portion in a plan view along an axial direction with respect to the wave cam.

21. The compressor as set forth in claim 20, wherein each of said cam surfaces includes a part of surface of a preselected imaginary cylindroid.

22. The compressor as set forth in claim 21, wherein said shoe includes a flat surface contacting said cam surface and a spherical surface coupled to the double-head piston.

23. The compressor as set forth in claim 22, wherein said second portion has the width narrower than a width of a flat surface of each of the shoes.

24. The compressor as set forth in claim 20, wherein each of said cam surfaces further includes:

another first portion to form a pair of first portions with said first portion;

another second portion to form a pair of second portions with said second portion;

said pair of first portions being separated from one another by 180°;

said pair of second portions being separated from one another by 180°; and each of said pair of first portions being separated from the adjacent second portion by 90°.

25. The compressor as set forth in claim 21 further comprising:

a boss provided with the wave cam to firmly receive the drive shaft;

said wave cam including a groove and a recess;

each of said cam surface circularly extending about the boss;

said groove being arranged adjacent to the first portion;

said recess being arranged adjacent to the second portion; and said recess outwardly expanding with respect to the groove to narrow the second portion as compared to the first portion.

26. The compressor as set forth in claim 21 further comprising:

a boss provided with the wave cam to firmly receive the drive shaft;

said wave cam including a groove and a recess;

each of said cam surfaces circularly extending about the boss; and said second portion being inwardly cut away for a predetermined amount to narrow the second portion with respect to the first portion.

27. The compressor as set forth in claim 21, wherein said imaginary cylindroid includes a convex surface obtainable from a director curve including a preselected parabolic curve.

28. The compressor as set forth in claim 21, wherein said imaginary cylindroid includes a parabolic surface obtainable from a preselected parabolic curve as a director curve.

29. The compressor as set forth in claim 21, wherein each of said cam surfaces further includes:

another first portion to form a pair of first portions with said first portion;

another second portion to form a pair of second portions with said second portion;

said pair of first portions being separated from one another by 180°;

said pair of second portions being separated from one another by 180°; and each of said pair of first portions being separated from the adjacent second portion by 90°.

30. A compressor having a wave cam supported on a drive shaft for an integral rotation and a plurality of pairs of cylinder bores arranged around an axis of said drive shaft, each pair of said cylinder bores being arranged opposite to one another with respect to the wave cam along said axis, a plurality of double-headed pistons respectively disposed in said cylinder bores, said wave cam having a pair of opposing cam surfaces having an identical cam profile and coupled to each of said double-headed pistons by way of a pair of shoes respectively contacting the cam surfaces for a relative movement to the cam surfaces to reciprocally drive a pair of piston heads of the associated double-headed piston between a top dead center and a bottom dead center of a piston stroke in the associated pair of the cylinder bores, wherein fluid is supplied to each cylinder bore based on a movement of each piston head to the bottom dead center from the top dead center, and wherein said fluid is compressed in each cylinder bore based on the movement of each piston head to the top dead center from the bottom dead center, said compressor comprising:

each of said cam surfaces including a part of surface of a preselected imaginary cylindroid;

each of said cam surfaces having a first portion which includes a point corresponding to the top dead center of the piston stroke and a second portion which includes a point corresponding to the bottom dead center of the piston stroke;

said second portion having a width narrower than a width of the first portion in a plan view along an axial direction with respect to the wave cam;

each of said shoes including flat surface contacting said cam surface and a spherical surface coupled to the double-headed piston; and said width of the second portion being narrower than a width of said flat surface of each of said shoes.

31. The compressor as set forth in claim 30 further comprising:

a boss provided with each surface of the wave cam to firmly receive the drive shaft;

said wave cam including a groove and a recess between the cam surface and the boss on each surface of the wave cam;

each of said cam surfaces circularly extending about the boss;

said groove being arranged adjacent to the first portion;

said recess being arranged adjacent to the second portion; and said recess outwardly expanding with respect to the groove to narrow the second portion as compared to the first portion.

32. The compressor as set forth in claim 30 further comprising:

a boss provided with each surface of the wave cam to firmly receive the drive shaft;

said wave cam including a groove and a recess between the cam surface and the boss on each surface of the wave cam;

each of said cam surfaces circularly extending about the boss; and said second portion being inwardly cut away for a predetermined amount to narrow the second portion with respect to the first portion.

33. The compressor as set forth in claim 30, wherein said imaginary cylindroid includes a parabolic surface obtainable from a preselected parabolic curve as a director curve.

34. A compressor having a wave cam supported on a drive shaft for an integral rotation and a plurality of pairs of cylinder bores arranged around an axis of said drive shaft, each pair of said cylinder bores being arranged opposite to one another with respect to the wave cam along said axis, a plurality of double-headed pistons respectively disposed in said cylinder bores, said wave cam having a pair of opposing cam surfaces having an identical cam profile and coupled to each of said double-headed pistons by way of a pair of shoes respectively contacting the cam surfaces for a relative movement to the cam surfaces to reciprocally drive a pair of piston heads of the associated double-headed piston between a top dead center and a bottom dead center of a piston stroke in the associated pair of the cylinder bores, wherein fluid is supplied to each cylinder bore based on a movement of each piston head to the bottom dead center from the top dead center, and wherein said fluid is compressed in each cylinder bore based on the movement of each piston head to the top dead center from the bottom dead center, said compressor comprising:

(a) each of said cam surfaces including a part of surface of a preselected imaginary cylindroid;

a first portion which includes a point corresponding to the top dead center of the piston stroke;

a second portion which includes a point corresponding to the bottom dead center of the piston stroke;

another first portion to form a pair of first portions with said first portion;

another second portion to form a pair of second portions with said second portion;

said pair of first portions being separated from one another by 180°;

said pair of second portions being separated from one another by 180°;

each of said pair of first portions being separated from the adjacent second portion by 90°; and said second portion having a width narrower than a width of the first portion in a plan view along an axial direction with respect to the wave cam;

(b) each of said shoes including a flat surface contacting said associated cam surface; and a spherical surface coupled to the associated double-headed piston, wherein said second portion has the width narrower than a width of said flat surface of each of the shoes.

35. The compressor as set forth in claim 34 further comprising:

a boss provided between the cam surface and the boss on each surface of the wave cam to firmly receive the drive shaft;

said wave cam including a groove and a recess;

each of said cam surfaces circularly extending about the boss;

said groove being arranged adjacent to the first portion;

said recess being arranged adjacent to the second portion;

said recess outwardly expanding with respect to the groove to narrow the second portion as compared to the first portion; and said imaginary cylindroid including a parabolic surface obtainable from a preselected parabolic curve as a director curve.

36. The compressor as set forth in claim 34 further comprising:

a boss provided with each surface of the wave cam to firmly receive the drive shaft;

said wave cam including a groove and a recess between the cam surface and the boss on each surface of the wave cam;

each of said cam surfaces circularly extending about the boss;

said second portion being inwardly cut away for a predetermined amount to narrow the second portion with respect to the first portion; and said imaginary cylindroid including a parabolic surface obtainable from a preselected parabolic curve as a director curve.

37. The compressor as set forth in claim 34 further comprising:

a boss provided with each surface of the wave cam to firmly receive the drive shaft;

said wave cam including a groove and a recess between the cam surface and the boss on each surface of the wave cam;

each of said cam surfaces circularly extending about the boss;

said groove being arranged adjacent to the first portion;

said recess being arranged adjacent to the second portion;

said recess outwardly expanding with respect to the groove to narrow the second portion as compared to the first portion; and said second portion being inwardly cut away for a predetermined amount to narrow the second portion with respect to the first portion.

38. The compressor as set forth in claim 37, wherein said imaginary cylindroid includes a parabolic surface obtainable from a preselected parabolic curve as a director curve.

* * * * *